US009136632B2

(12) United States Patent
Yu et al.

(10) Patent No.: US 9,136,632 B2
(45) Date of Patent: Sep. 15, 2015

(54) ELECTRICAL CONNECTOR WITH RELIABLE ASSEMBLY EFFECT

(71) Applicant: ALLTOP ELECTRONICS (SUZHOU) LTD., Taicang, JiangSu Province (CN)

(72) Inventors: Wang-I Yu, Jhonghe (TW); Siu-Mien Yang, Jhonghe (TW); Chun-Hsien Wu, Jhonghe (TW); Hung-Chi Tai, Jhonghe (TW)

(73) Assignee: ALLTOP ELECTRONICS (SUZHOU) LTD., Taicang, JiangSu Province (CN)

( * ) Notice: Subject to any disclaimer, the term of this patent is extended or adjusted under 35 U.S.C. 154(b) by 29 days.

(21) Appl. No.: 14/068,728

(22) Filed: Oct. 31, 2013

(65) Prior Publication Data

US 2014/0370761 A1 Dec. 18, 2014

(30) Foreign Application Priority Data

Jun. 17, 2013 (CN) ..... 2013 1 0238750

(51) Int. Cl.
*H01R 24/00* (2011.01)
*H01R 13/405* (2006.01)
*H01R 24/64* (2011.01)

(52) U.S. Cl.
CPC ..... *H01R 13/405* (2013.01); *H01R 24/64* (2013.01)

(58) Field of Classification Search
CPC . H01R 23/7073; H01R 23/025; H01R 23/005
USPC ..... 439/79, 607.26, 620.11, 676, 941
See application file for complete search history.

(56) References Cited

U.S. PATENT DOCUMENTS

| | | | | |
|---|---|---|---|---|
| 6,413,121 | B1 * | 7/2002 | Hyland | 439/676 |
| 6,612,877 | B2 * | 9/2003 | Hyland | 439/676 |
| 6,623,306 | B2 * | 9/2003 | Xu et al. | 439/676 |
| 7,708,603 | B1 * | 5/2010 | Little | 439/676 |
| 7,931,503 | B2 * | 4/2011 | Zhuang | 439/676 |
| 8,246,389 | B2 * | 8/2012 | Zhang et al. | 439/676 |
| 2003/0119370 | A1 | 6/2003 | Xu et al. | |

* cited by examiner

*Primary Examiner* — Thanh Tam Le
(74) *Attorney, Agent, or Firm* — Sughrue Mion, PLLC

(57) ABSTRACT

A connector includes a housing and a contact module received in the housing. The housing defines a receiving cavity for accommodating a complementary connector, a mounting space communicating with the receiving cavity, and a pair of mounting blocks located at opposite lateral sides of the mounting space. The contact module includes a base and a number of contacts fixed in the base. The base includes a pair of lateral side edges. Each contact includes a retaining portion fixed in the base and a contacting portion extending slantly from the retaining portion into the receiving space of the housing. The contacts include a pair of side contacts located at opposite outmost sides thereof. The retaining portion of each side contact is disposed with a protruding section protruding laterally beyond corresponding lateral side edge of the base to engage with respective mounting block formed on the housing.

13 Claims, 6 Drawing Sheets

ELECTRICAL CONNECTOR WITH RELIABLE ASSEMBLY EFFECT

BACKGROUND OF THE INVENTION

1. Field of the Invention

The present invention relates to an electrical connector, more particularly to an RJ45 receptacle connector.

2. Description of Related Art

US Patent Publication No. US 2003/0119370A1, published on Jun. 26, 2003, disclosed an electrical connector comprising an insulative housing, a contact module assembled to the insulative housing, and a conductive shell enclosing the insulative housing. The insulative housing defines a receiving space for accommodating a complementary plug and a retaining space for accommodating the contact module. The contact module comprises an insulative base retained in the retaining space of the insulative housing and a plurality of conductive contacts molded with the insulative base and extending into the receiving space of the insulative housing. However, one issue existed in the prior art is there is a big gap between the contact module and the insulative housing, thus, the assembly between the contact module and the insulative housing is not stable and reliable.

Hence, it is necessary to improve the conventional electrical connector to address problems mentioned above.

BRIEF SUMMARY OF THE INVENTION

Accordingly, an object of the present invention is to provide an electrical connector which is assembled conveniently and reliably.

In order to achieve the above-mentioned object, an electrical connector in accordance with the present invention comprises an insulative housing and a contact module received in the insulative housing. The insulative housing defines a receiving cavity for accommodating a complementary connector, a mounting space communicating with the receiving cavity to receive the contact module, and a pair of mounting blocks located at opposite lateral sides of the mounting space. The contact module comprises an insulative base received in the mounting space and a plurality of conductive contacts fixed in the insulative base. The insulative base comprises a pair of lateral side edges. Each conductive contact comprises a retaining portion fixed in the insulative base and a contacting portion extending slantly from the retaining portion into the receiving space of the insulative housing. The conductive contacts comprise a pair of side contacts located at opposite outmost sides thereof. The retaining portion of each side contact is disposed with a protruding section protruding laterally beyond corresponding lateral side edge of the insulative base to engage with respective mounting block formed on the insulative housing.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
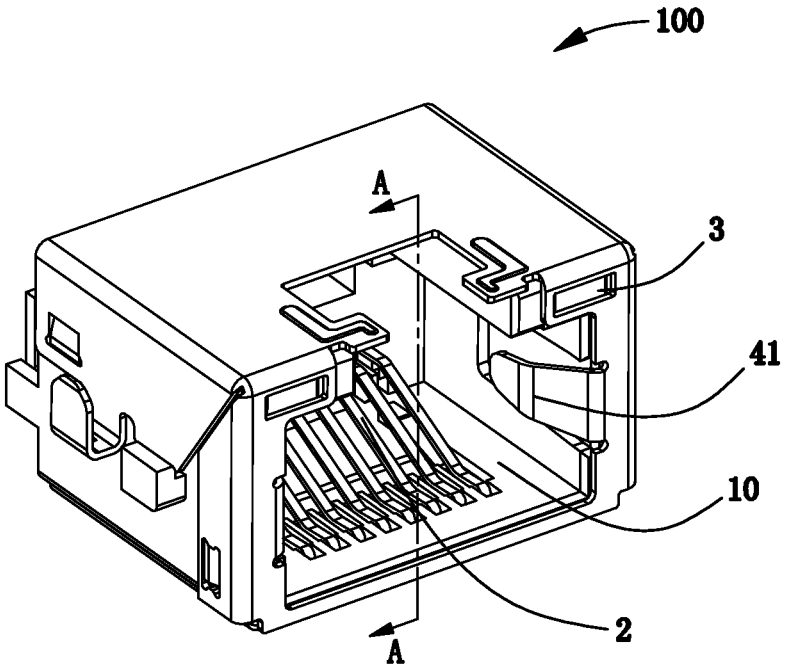
FIG. 1 is an assembled, perspective view of an electrical connector in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
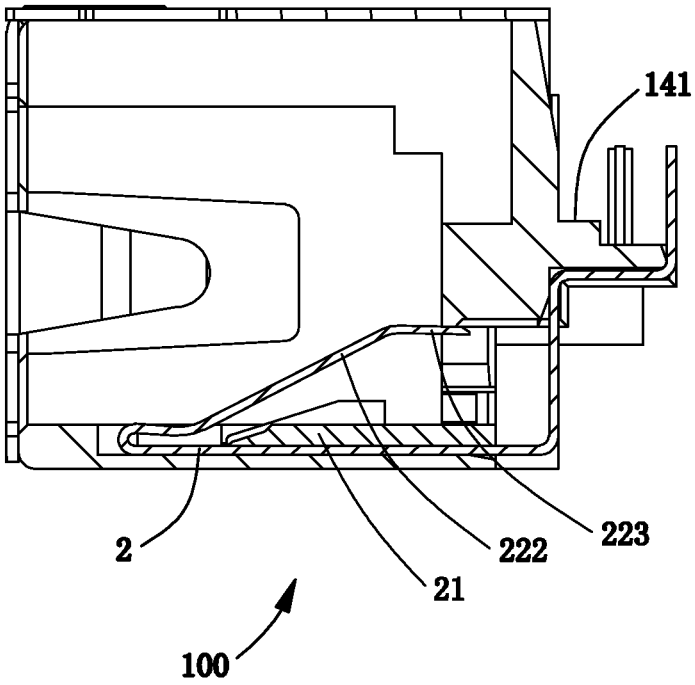
FIG. 2 is a cross-section view of the electrical connector taken along line A-A in FIG. 1.
Figure 3:
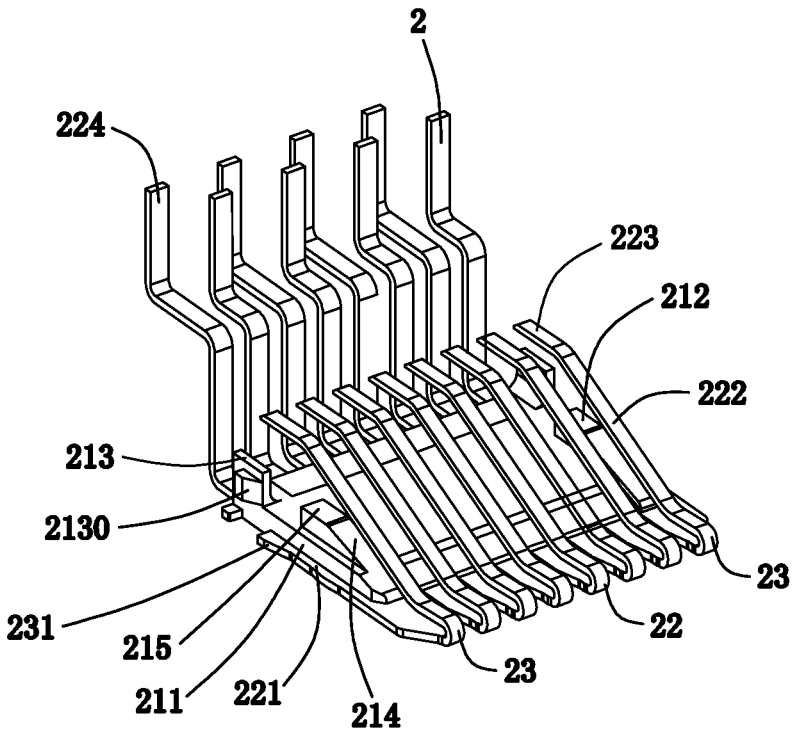
FIG. 3 is a perspective view of a contact module of the electrical connector in accordance with the present invention.
Figure 4:
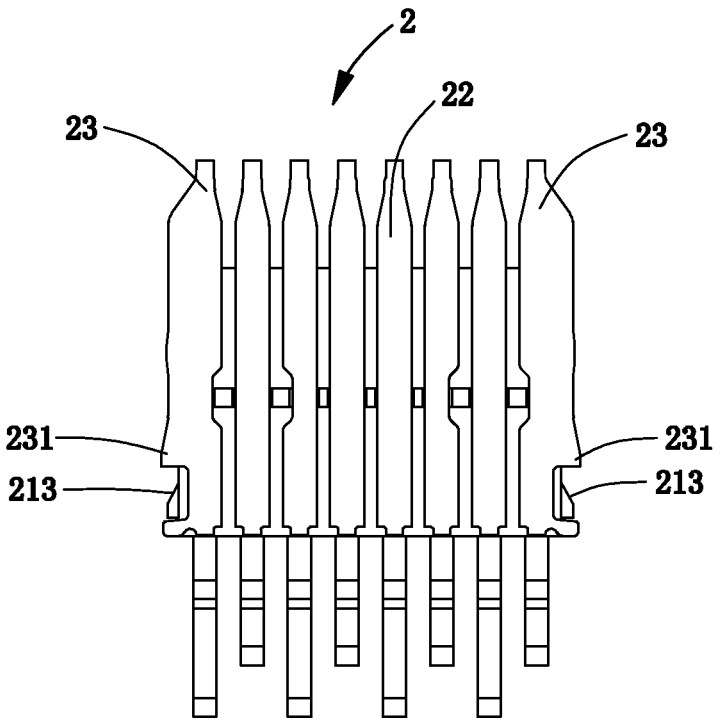
FIG. 4 is a bottom view of the contact module of the electrical connector in accordance with the present invention.
Figure 5:
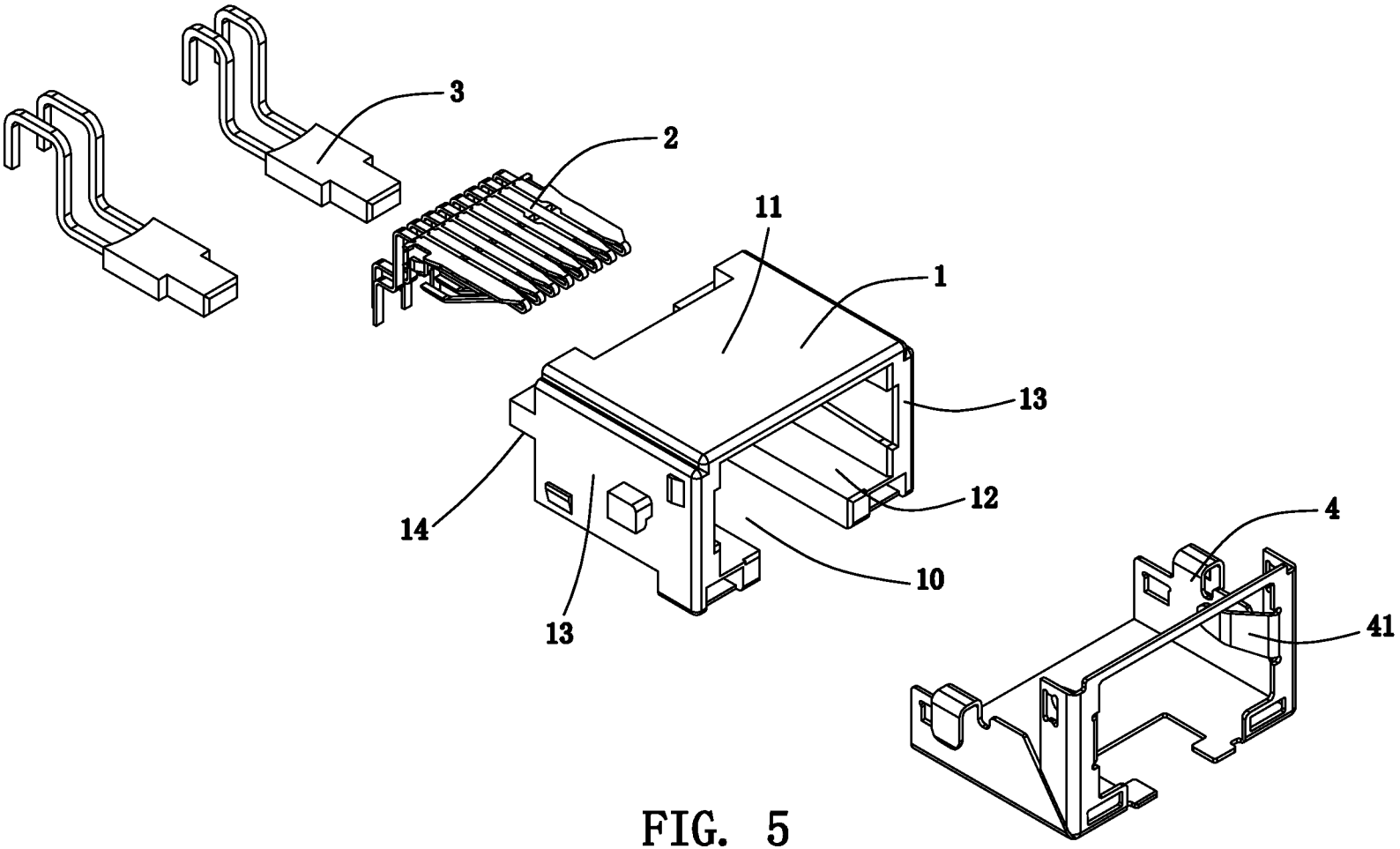
FIG. 5 is an exploded, perspective view of the electrical connector in accordance with the present invention.
Figure 6:
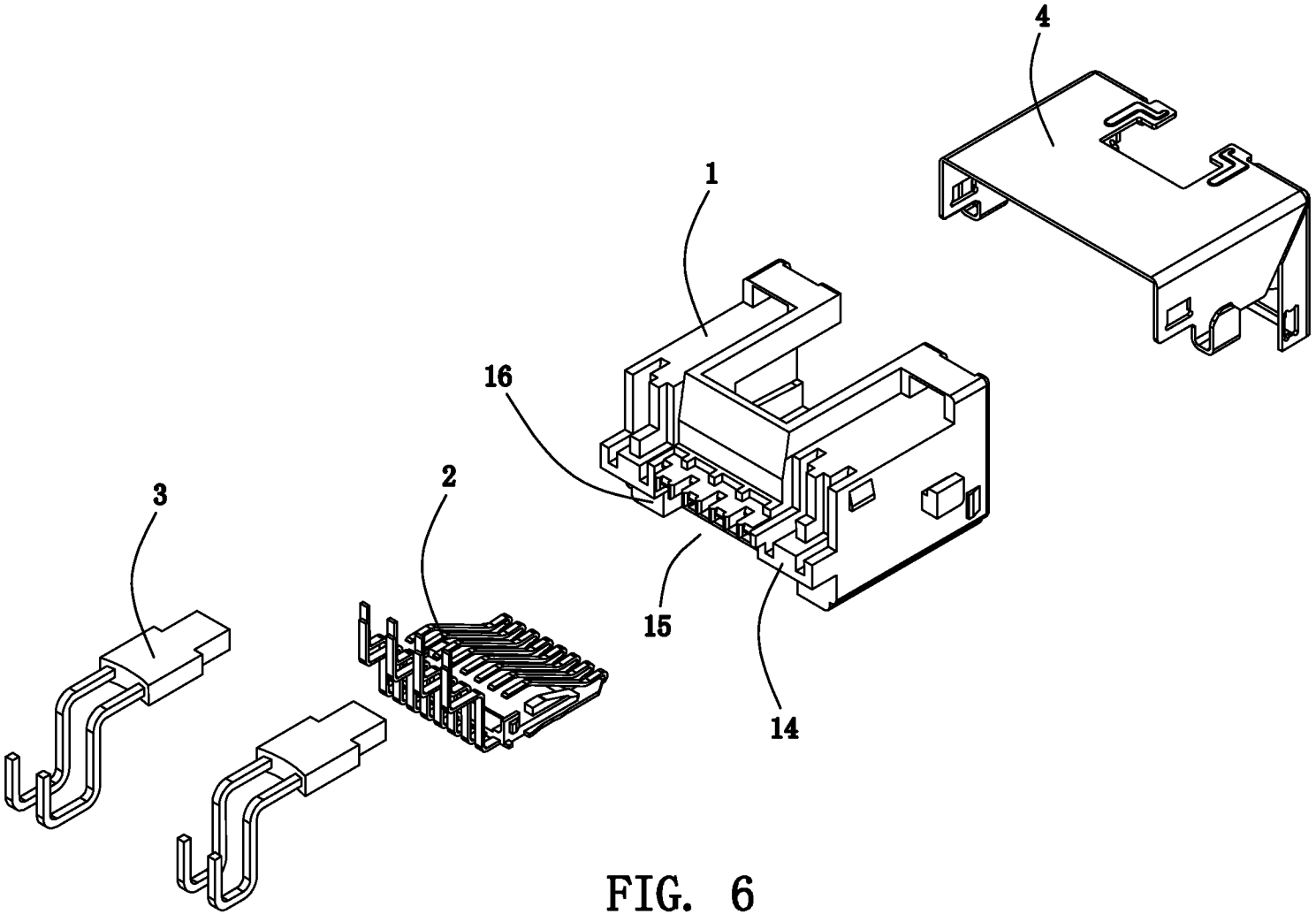
FIG. 6 is a view similar to FIG. 5, but from a different aspect.

Please refer to FIGS. 1-6, an electrical connector 100 in accordance with the present invention is capable of being mounted to a Printed Circuit Board (PCB, not shown) and electrically connecting with a complementary plug connector. In the preferred embodiment of the present invention, the electrical connector 100 is an RJ45 receptacle connector.

The electrical connector 100 comprises an insulative housing 1, a contact module 2 assembled to the insulative housing 1, a pair of LED elements 3 assembled to the insulative housing 1, and a conductive shell 4 enclosing the insulative housing 1.

The insulative housing 1 comprises a top wall 11, a bottom wall 12 opposite to the top wall 11, a pair of sidewalls 13 and a rear wall 14. A receiving cavity 10 is circumscribed by the top wall 11, the bottom wall 12, the sidewalls 13 and the rear wall 14. The insulative housing 1 also defines an mounting space 15 communicating with the receiving cavity 10 for accommodating the contact module 2, and a pair of mounting blocks 16 located at opposite lateral sides of the mounting space 15. The rear wall 14 comprises a mounting face 141 for mounting the electrical connector 100 to the PCB. The mounting face 141 is located between the top wall 11 and the bottom wall 12 for reducing the height of the electrical connector 100.

The contact module 2 comprises an insulative base 21 received in the mounting space 15, and a plurality of conductive contacts 22 fixed to the insulative base 21. In the preferred embodiment of the present invention, the conductive contacts 22 are insert-molded with the insulative base 21. However, in alternative embodiments, the conductive contacts 22 also could be assembled to the insulative base 21 or other possible ways. Such contact module structure, avoids assembling the conductive contacts 22 to the insulative housing 1 directly. It is a fast and convenient assembly way. The insulative base 21 comprises a pair of lateral side edges 211, a pair of spaced restriction blocks 212 protruding upwardly from an upper surface thereof and adjacent to respective lateral side edges 211, and a pair of vertical restriction sections 213 at a rear end thereof and bending upwardly from the lateral side edges 211. Each restriction section 213 is formed with a wedged latch section 2130 on an outer surface thereof. The distance between the pair of latch sections 2130 is bigger than that of the pair of restriction blocks 212.

Each conductive contact 22 comprises a flat retaining portion 221 retained to the insulative base 21, a Z-shape termination portion 224 bending vertically from one end of the retaining portion 221 for being soldered to the PCB, a contacting portion 222 extending slantly from the other end of the retaining portion 221 and toward the termination portion 224 for electrically connecting with the complementary plug connector. A flat contacting end 223 is formed at a free end of the contacting portion 222. There is a pair of side contacts 23 located at outermost sides of the conductive contacts 22. The retaining portion 221 of each side contact 23 is disposed with a protruding section 231 protruding sideward therefrom. The protruding section 231 protrudes beyond the lateral side edges 211 of the insulative base 21 to interferentially engage with the mounting block 16 for retaining the contact module 2 to the insulative housing 1 reliably. In the preferred embodiment of the present invention, the protruding section 231 is in the form of a plurality of barbs interferentially engaging with the mounting block 16.

In the preferred embodiment of the present invention, the width of the retaining portion 221 of the side contact 23 is larger than that of the retaining portions 221 of other conductive contacts 22. Such arrangement could enhance the strength of the retaining portions 221 of the side contacts 23, thus, preventing deformation. The latch sections 2130 of the restriction sections 213 also press against the mounting blocks 16 respectively for positioning and fixing the contact module 2 to the insulative housing 1. The side contacts 23 are compressed by the complementary plug connector to be pressed against the restriction blocks 212 respectively for preventing excessive deformation of the contacting portions 222. In detail, the restriction block 212 comprises an inclined surface 214 cooperating with the contacting portion 222, and a flat pressing surface 215 cooperating with the flat contacting end 223. Such arrangement is because the side contacts 23 are not so easy to be damaged under the protection of the restriction blocks 212, and it could save material without other restriction blocks 212 under other conductive contacts 22.

The conductive shell 4 encloses the insulative housing 1 with elastic arms 41 extending into the receiving cavity 10 of the insulative housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector, comprising:

an insulative housing defining a receiving cavity adapted for accommodating a complementary connector, a mounting space communicating with the receiving cavity to receive a contact module, and a pair of mounting blocks located at opposite lateral sides of the mounting space;

the contact module received in the insulative housing and comprising an insulative base received in the mounting space and a plurality of conductive contacts fixed in the insulative base, the insulative base comprising a pair of lateral side edges, each conductive contact comprising a retaining portion fixed in the insulative base and a contacting portion extending slantly from the retaining portion into the receiving space of the insulative housing; and wherein the conductive contacts comprise a pair of side contacts located at opposite outmost sides thereof, the retaining portion of each side contact is disposed with a protruding section protruding laterally beyond corresponding lateral side edge of the insulative base to engage with respective mounting block formed on the insulative housing;

wherein the insulative base forms a pair of restriction blocks on an upper surface thereof, and each restriction block is located under respective contacting portion of the side contact to prevent the contacting portion of the side contacts from being deformed excessively.

2. The electrical connector as claimed in claim 1, wherein a width of the retaining portion of the side contact is bigger than a width of each of other conductive contacts.

3. The electrical connector as claimed in claim 1, wherein the protruding section of the side contact interferentially engages with the mounting block of the insulative housing.

4. The electrical connector as claimed in claim 1, wherein the restriction block is formed with an inclined surface to cooperate with the contacting portion of the side contact.

5. The electrical connector as claimed in claim 4, wherein the conductive contact forms a flat contacting end at a free end of the contacting portion, and wherein the restriction block forms a flat pressing surface to be pressed by the contacting end of the side contact.

6. The electrical connector as claimed in claim 1, wherein the protruding section of each side contact extends laterally beyond the restriction block of the insulative base.

7. The electrical connector as claimed in claim 1, wherein the insulative base forms a pair of restriction sections abutting against the pair of mounting blocks of the insulative housing.

8. The electrical connector as claimed in claim 7, wherein the restriction section bends upwardly from opposite lateral sides of the insulative base, and wherein each restriction section is formed with a wedged latch section abutting against corresponding mounting block of the insulative housing.

9. The electrical connector as claimed in claim 7, wherein a distance between the pair of restriction sections is larger than a distance of the pair of restriction blocks.

10. The electrical connector as claimed in claim 1, wherein the insulative housing comprises a top wall, a bottom wall, a pair of sidewalls and a rear wall, the receiving cavity is circumscribed by the top wall, the bottom wall, the sidewalls and the rear wall, a mounting face is formed on the rear wall of the insulative housing adapted for mounting the electrical connector to a Printed Circuit Board, and wherein the mounting face is located between the top wall and the bottom wall.

11. The electrical connector as claimed in claim 1, further comprising a conductive shell enclosing the insulative housing with at least one elastic arm extending into the receiving cavity of the insulative housing.

12. The electrical connector as claimed in claim 1, further comprising a pair of LED elements assembled to the insulative housing and located at opposite lateral sides of the conductive contacts.

13. An electrical connector, comprising:

an insulative housing defining a receiving cavity adapted for accommodating a complementary connector, a mounting space communicating with the receiving cavity to receive the contact module, and a pair of mounting blocks located at opposite lateral sides of the mounting space;

a contact module received in the insulative housing and comprising an insulative base received in the mounting space and a plurality of conductive contacts fixed in the insulative base, the insulative base comprising a pair of lateral side edges, each conductive contact comprising a retaining portion fixed in the insulative base and a contacting portion extending slantly from the retaining portion into the receiving space of the insulative housing; and wherein the conductive contacts comprise a pair of side contacts located at opposite outmost sides thereof, the retaining portion of each side contact is disposed with a protruding section protruding laterally beyond corresponding lateral side edge of the insulative base to engage with respective mounting block formed on the insulative housing;

wherein the insulative housing comprises a top wall, a bottom wall, a pair of sidewalls and a rear wall, the receiving cavity is circumscribed by the top wall, the bottom wall, the sidewalls and the rear wall, a mounting face is formed on the rear wall of the insulative housing adapted for mounting the electrical connector to a Printed Circuit Board, and wherein the mounting face is located between the top wall and the bottom wall.

* * * * *